US008507883B2

(12) United States Patent
Endo et al.

(10) Patent No.: US 8,507,883 B2
(45) Date of Patent: Aug. 13, 2013

(54) EXTREME ULTRAVIOLET LIGHT SOURCE APPARATUS

(75) Inventors: Akira Endo, Hiratsuka (JP); Hideo Hoshino, Hiratsuka (JP); Kouji Kakizaki, Hiratsuka (JP); Tamotsu Abe, Hiratsuka (JP); Akira Sumitani, Hiratsuka (JP); Takanobu Ishihara, Hiratsuka (JP); Shinji Nagai, Hiratsuka (JP); Osamu Wakabayashi, Hiratsuka (JP); Hakaru Mizoguchi, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 595 days.

(21) Appl. No.: 12/559,977

(22) Filed: Sep. 15, 2009

(65) Prior Publication Data

US 2010/0090132 A1 Apr. 15, 2010

(30) Foreign Application Priority Data

Sep. 16, 2008 (JP) ..... 2008-236624

(51) Int. Cl.
*G21G 4/00* (2006.01)

(52) U.S. Cl.
USPC ..... 250/504 R; 250/423 R; 250/424; 250/425; 250/493.1

(58) Field of Classification Search
USPC ..... 250/504 R, 423 R, 424.425, 493.1
See application file for complete search history.

(56) References Cited

U.S. PATENT DOCUMENTS

| | | | | |
|---|---|---|---|---|
| 3,922,516 | A * | 11/1975 | Valtchev et al. | 219/73.1 |
| 6,987,279 | B2 * | 1/2006 | Hoshino et al. | 250/504 R |
| 7,732,793 | B2 * | 6/2010 | Ershov et al. | 250/504 R |
| 8,129,700 | B2 * | 3/2012 | Ueno et al. | 250/504 R |
| 2005/0167618 | A1 * | 8/2005 | Hoshino et al. | 250/504 R |
| 2006/0131515 | A1 * | 6/2006 | Partlo et al. | 250/504 R |
| 2006/0186356 | A1 * | 8/2006 | Imai et al. | 250/504 R |
| 2007/0228298 | A1 * | 10/2007 | Komori et al. | 250/493.1 |
| 2008/0035865 | A1 * | 2/2008 | Komori et al. | 250/504 R |
| 2008/0083887 | A1 * | 4/2008 | Komori et al. | 250/504 R |
| 2009/0218522 | A1 * | 9/2009 | Nakano et al. | 250/504 R |
| 2010/0050845 | A1 * | 3/2010 | Ipatenco | 83/698.21 |
| 2010/0304976 | A1 * | 12/2010 | Overweg et al. | 505/162 |

FOREIGN PATENT DOCUMENTS

| | | |
|---|---|---|
| JP | 2005-197456 | 7/2005 |
| WO | 02/46839 | 6/2002 |

* cited by examiner

*Primary Examiner* — Michael Logie
(74) *Attorney, Agent, or Firm* — McDermott Will & Emery LLP

(57) ABSTRACT

An extreme ultraviolet light source apparatus provided with a magnetic field forming unit having sufficient capability of protection against ions radiated from plasma while using a relatively small magnetic source. The apparatus includes: a target nozzle for injecting a target material; a driver laser for applying a laser beam to the target material to generate plasma; a collector mirror for collecting extreme ultraviolet light radiated from the plasma; and a magnetic field forming unit including at least one magnetic source and at least one magnetic material having two leading end parts projecting from the at least one magnetic source to face each other with a plasma emission point in between, and forming a magnetic field between a trajectory of the target material and the collector mirror.

19 Claims, 14 Drawing Sheets

EXTREME ULTRAVIOLET LIGHT SOURCE APPARATUS

CROSS-REFERENCE TO RELATED APPLICATION

The present application claims priority from Japanese Patent Application No. 2008-236624 filed on Sep. 16, 2008, the contents of which are incorporated herein by reference in their entirety.

BACKGROUND OF THE INVENTION

1. Field of the Invention

The present invention relates to an extreme ultraviolet (EUV) light source apparatus for generating ultraviolet light by applying a laser beam to a target material to turn the target material into plasma.

2. Description of a Related Art

In recent years, as semiconductor processes become finer, photolithography has been making rapid progress toward finer fabrication. In the next generation, micro-fabrication at 60 nm to 45 nm, further, micro-fabrication at 32 nm and beyond will be required. Accordingly, for example, exposure equipment is expected to be developed by combining an EUV light source for generating EUV light having a wavelength of about 13 nm and reduced projection reflective optics.

As the EUV light source, there is an LPP (laser produced plasma) light source using plasma generated by applying a laser beam to a target (hereinafter, also referred to as "LPP type EUV light source apparatus"). The LPP light source has advantages that extremely high intensity close to black body radiation can be obtained because plasma density can be considerably made larger, that the light emission of only the necessary waveband can be performed by selecting the target material, and that an extremely large collection solid angle of $2\pi$ to $4\pi$ steradian can be ensured because it is a point light source having substantially isotropic angle distribution and there is no structure such as electrodes surrounding the light source. Therefore, the LPP light source is considered to be predominant as a light source for EUV lithography, which requires power of more than several tens of watts to one hundred of watts.

In the LPP type EUV light source apparatus, by injecting a target material from a nozzle and applying a laser beam to the target material, the target material is excited and turned into plasma. Various wavelength components including extreme ultraviolet (EUV) light are radiated from the plasma. Then, a desired wavelength component of them is selectively reflected and collected by using a collector mirror (an EUV collector mirror), and outputted to a unit using EUV light (e.g., exposure unit). For example, in order to collect EUV light having a wavelength near 13.5 nm, an EUV collector mirror having a reflecting surface, on which a multilayer coating of alternately stacked molybdenum and silicon (Mo/Si multilayer coating) is formed, is used.

In the LPP type EUV light source apparatus, the influence of neutral particles and ions having various velocities emitted from plasma on the EUV collector mirror is problematic. Since the EUV collector mirror is located near the plasma, the neutral particles and low-velocity ions emitted from the plasma adhere to the reflecting surface of the EUV collector mirror and reduce the reflectance of the EUV collector mirror. On the other hand, the fast ions emitted from the plasma damage the multilayer coating formed on the reflecting surface of the EUV collector mirror (in this application, this is referred to as "sputtering").

It is considered that neutral particles can be suppressed by optimizing the process of generating fully-ionized plasma according to various methods such as a double-pulse application method and a minimum mass target method that is described in International Publication WO 02/46839 A2. However, ion generation is inevitable as long as the plasma is generated. Accordingly, measures for ions are absolutely necessary.

The low-velocity ions adhere to the EUV collector mirror and reduce the reflectance thereof. Since the ions only adhere to the EUV collector mirror, in principle, the adhesions can be removed by a cleaning technology using a reactive gas or the like. After cleaning, the reflectance of the EUV collector mirror is recovered and the EUV collector mirror can continuously be used. However, in order to fulfill the requirement for an EUV light source apparatus for exposure (a period in which the reflectance decreases by 10% is one year or more), an amount of adherence (thickness) of a metal film on the reflecting surface of the EUV collector mirror is acceptable as a very small value of about 0.75 nm for tin (Sn). Accordingly, it is necessary to perform high-speed cleaning at a high frequency.

On the other hand, fast ions sputter the surface of the EUV collector mirror, and damage the reflecting coating to reduce the reflectance. When the EUV collector mirror is damaged and its reflectance becomes lower, replacement of the EUV collector mirror is required. A technology of reproducing the reflecting coating within the EUV light source apparatus is also available, however, it is necessary to add a high-accuracy coating formation apparatus for providing high surface flatness of about 0.2 nm (rms), for example, and that increases cost. Further, due to the damage distribution, it is substantially impossible to obtain a uniform reflectance distribution even when the reflecting coating is reproduced.

Therefore, generally, several hundreds of layers of reflecting coatings have been deposited for extending the lifetime of the EUV collector mirror until replacement. Further, as a method of reducing the damage density of fast ions, there is a method of separating the distance between the EUV collector mirror and a plasma generation point (light emission point). In this case, there has been a problem that the catching solid angle of the EUV light becomes smaller and the output of available EUV light becomes lower. In order to solve the problem, for example, a method of using an EUV collector mirror having a large diameter equal to or more than $\phi$500 mm is conceivable. However, there are problems that it is difficult to generate several hundreds of layers of reflecting coatings while maintaining the surface roughness and form accuracy, and such an EUV collector mirror is expensive even if it can be fabricated.

In order to solve the problems, Japanese Patent Application Publication JP-P2005-197456A discloses an EUV light source apparatus including a magnetic field generating unit for generating a magnetic field within a collective optics when current is supplied, and trapping charged particles emitted from plasma by using the magnetic field to prevent adherence of the target material to the EUV collector mirror and sputtering of the EUV collector mirror.

FIG. 21 schematically shows a configuration of the EUV light source apparatus according to JP-P2005-197456A. The EUV light source apparatus includes a target supply unit, a driver laser for applying a laser beam to a target, and an EUV collector mirror for collecting EUV light to output the EUV light. As shown in FIG. 22, a pair of electromagnetic coils having magnetic poles directed toward the same direction are provided with a part, where the laser beam is applied to the target, in between. The pair of electromagnetic coils form a mirror magnetic field around the laser application part and capture the charged particles flying from the target within the magnetic field to prevent the charged particles from reaching the EUV collector mirror.

However, in order to deflect fast ions having energy up to 10 keV not to reach the EUV collector mirror, a strong magnetic field is necessary. In order to form a strong magnetic field in a space around the EUV collector mirror as shown in FIG. 21, Helmholtz coils having a gap equal to or more than the diameter (e.g., ϕ300 mm) of the EUV collector mirror should be prepared. Such electromagnetic coils are very large and not only cause constraints on design but also cause upsizing of the apparatus and increase in the apparatus cost.

Further, since a strong magnetic field is generated within and around the EUV light source apparatus, materials that can be used inside and outside of the EUV apparatus are limited. This is because it should be avoided that the magnetic field acts on the structure or the servo motor and causes deformation of the structure or malfunction of the motor. Furthermore, there are problems of generating secondary cost in such a case where it is necessary to provide a magnetic field shield to cover the EUV light source apparatus and prevent malfunction of other apparatuses due to the strong magnetic field.

SUMMARY OF THE INVENTION

The present invention has been achieved in view of the above-mentioned problems. A purpose of the present invention is to provide an extreme ultraviolet light source apparatus including magnetic field forming means having sufficient capability of protection against ions radiated from plasma while using a relatively small magnetic source.

In order to accomplish the above-mentioned purpose, an extreme ultraviolet light source apparatus according to one aspect of the present invention is an extreme ultraviolet light source apparatus for generating extreme ultraviolet light by applying a laser beam to a target material to turn the target material into plasma, and the apparatus includes: a chamber in which extreme ultraviolet light is generated; a target nozzle for injecting a target material toward a predetermined plasma emission point within the chamber; a driver laser for applying a laser beam to the target material at the plasma emission point to generate plasma; a collector mirror for collecting the extreme ultraviolet light radiated from the plasma; and magnetic field forming means including at least one magnetic source and at least one magnetic material to be magnetized by the at least one magnetic source, the at least one magnetic material having two leading end parts projecting from the at least one magnetic source to face each other with the plasma emission point in between, and forming a magnetic field between a trajectory of the target material and the collector mirror.

According to the one aspect of the present invention, since the two leading end parts of the at least one magnetic material to be magnetized by the at least one magnetic source are provided to project from the at least one magnetic source with the plasma emission point in between, the magnetic flux is concentrated on the gap sandwiching the plasma emission point. Therefore, high-density lines of magnetic force can be formed without using a large magnetic source, and charged particles radiated from the plasma can be prevented from colliding with the EUV collector mirror. As a result, the degree of freedom of design can be improved, the entire apparatus can be downsized, and the apparatus cost can be reduced. Further, the strong magnetic field becomes local and the magnetic field is rapidly attenuated at a slight distance, and therefore, the constrains on materials within the extreme ultraviolet light source apparatus are relaxed, the magnetic field shield is simple also serving as an apparatus cover, and the apparatus cost is reduced.

DESCRIPTION OF THE PREFERRED EMBODIMENTS

Figure 1:
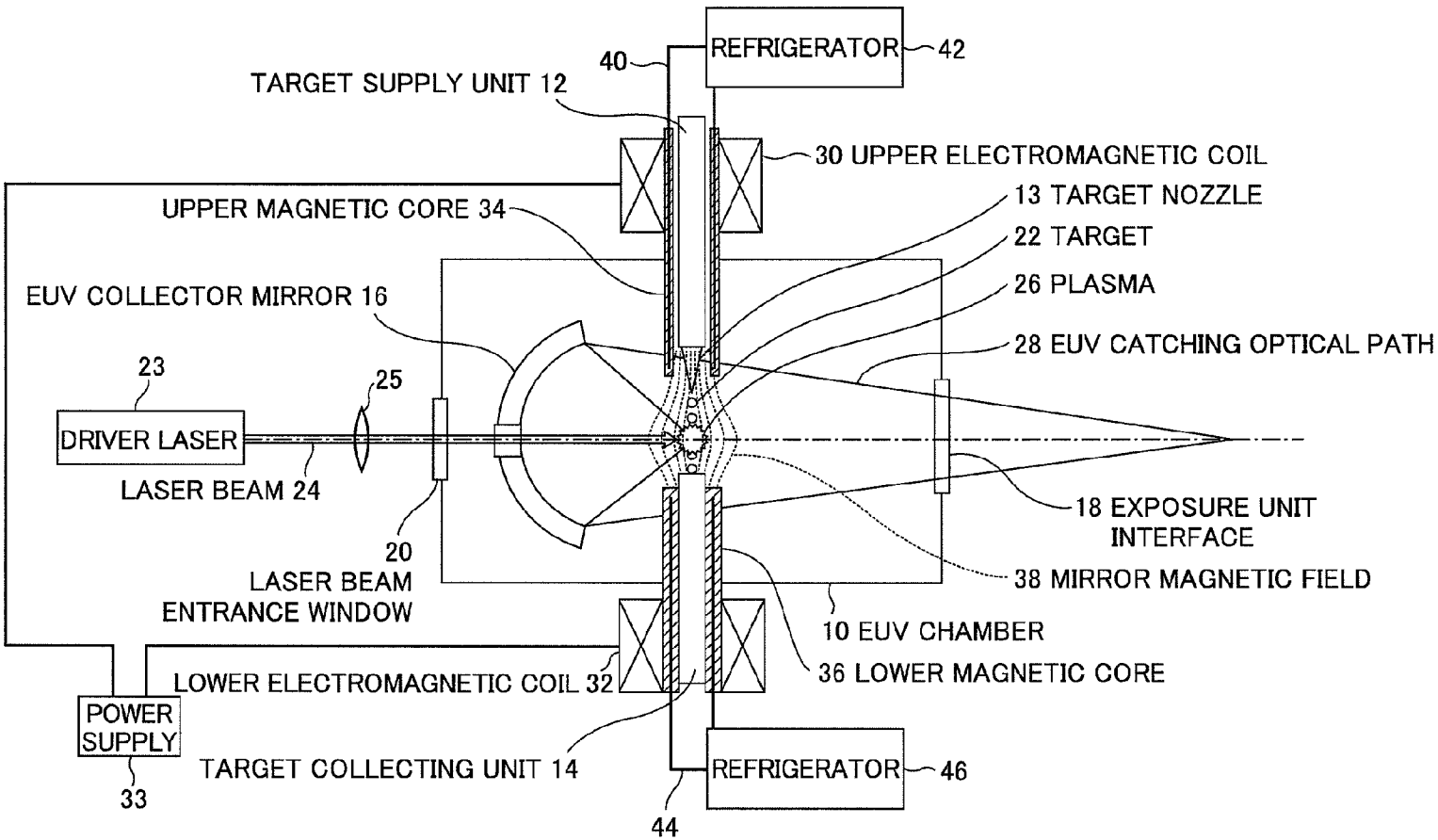
FIG. 1 is a side view showing a configuration of an extreme ultraviolet light source apparatus according to the first embodiment of the present invention.

Hereinafter, preferred embodiments of the present invention will be explained in detail by referring to the drawings.

The same reference numerals are assigned to the same component elements and the description thereof will be omitted.

Embodiment 1

FIG. 1 is a side view showing a configuration of an extreme ultraviolet light source apparatus according to the first embodiment of the present invention. The extreme ultraviolet (EUV) light source apparatus according to the embodiment employs a laser produced plasma (LPP) system for generating EUV light by applying a laser beam to a target material for excitation.

As shown in FIG. 1, the EUV light source apparatus includes an EUV chamber 10 in which EUV light is generated, a target supply unit 12 having a target nozzle 13 for injecting a target material on the leading end thereof, a target collecting unit (target collecting tube) 14, a driver laser 23 for generating a laser beam 24, a focusing lens 25, and an EUV collector mirror 16.

To the EUV chamber 10, a laser beam entrance window 20 for introducing the laser beam 24 into the EUV chamber 10 and an exposure unit interface 18 for guiding the collected EUV light to an external exposure unit are provided. Further, in the EUV collector mirror 16, an entrance hole for passing the laser beam 24 is formed.

Furthermore, the EUV light source apparatus includes an upper electromagnetic coil 30 and a lower electromagnetic coil 32 as magnetic sources, a power supply 33 for supplying current to the upper electromagnetic coil 30 and the lower electromagnetic coil 32, an upper magnetic core (magnetic material) 34 to be magnetized by the upper electromagnetic coil 30, and a lower magnetic core (magnetic material) 36 to be magnetized by the lower electromagnetic coil 32. The upper magnetic core 34 forming a cylinder is provided along the inner wall of the upper electromagnetic coil 30 to surround a pipe of the target supply unit 12. Further, the lower magnetic core 36 forming a cylinder is provided along the inner wall of the lower electromagnetic coil 32 to surround a target collecting tube of the target collecting unit 14. A refrigerant path 40 connected to a refrigerator 42 is formed within the upper magnetic core 34, and a refrigerant path 44 connected to a refrigerator 46 is formed within the lower magnetic core 36.

In the EUV light source apparatus, a target 22 is injected from the target nozzle 13 of the target supply unit 12. The state of the target material introduced into the target supply unit 12 may be gas, liquid, or solid. For example, when a target material in a gas state at the normal temperature such as xenon is used as a liquid target, the xenon gas is pressurized and cooled in the target supply unit 12 and the liquefied xenon is supplied to the target nozzle 13. On the other hand, for example, when a target material in a solid state at the normal temperature such as tin is used as a liquid target, the tin is heated in the target supply unit 12 and the liquefied tin is supplied to the target nozzle 13. In the embodiment, tin (Sn) droplets are used as the target 22.

The target nozzle 13 injects the target material supplied from the target supply unit 12 to supply the droplet target 22 to a predetermined position (plasma emission point) within the EUV chamber 10. The target nozzle 13 includes a vibration mechanism having a piezoelectric element or the like, and produces droplets of the target material according to the Rayleigh's stability theory of minute disturbance.

The driver laser 23 is a laser beam source that can perform pulse oscillation at a high-repetition frequency (e.g., pulse width of about several nanoseconds to several tens of nanoseconds and repetition frequency of about 10 kHz to 100 kHz), and outputs the laser beam 24 to be applied to the target 22 to turn the target 22 into plasma. Further, the focusing lens 25 collects the laser beam 24 outputted from the driver laser 23 and applies it to the plasma emission point (also referred to as "laser application position"). In place of the focusing lens 25, a collective optics including an optical component such as a mirror or a combination of plural optical components may be used.

The laser beam 24 is applied from the driver laser 23 through the focusing lens 25 and the laser beam entrance window 20 to the target 22. The laser entrance hole for passing the laser beam 24 is formed in the EUV collector mirror 16, and the laser beam 24 passes through the laser entrance hole and is applied to the target 22. Thereby, the target 22 is excited and plasma 26 is generated, and various lights including EUV light having a wavelength of 13.5 nm are radiated from the plasma 26.

The EUV collector mirror 16 is a collective optics for collecting a specific wavelength component (e.g., EUV light near 13.5 nm) from the various wavelength components radiated from the plasma 26. The EUV collector mirror 16 has a concave reflecting surface on which a molybdenum (Mo)/silicon (Si) multilayer coating for selectively reflecting the EUV light near 13.5 nm, for example, is formed. By the EUV collector mirror 16, the EUV light is reflected and collected in a predetermined direction along an EUV catching optical path 28 and outputted through the exposure unit interface 18 to the exposure unit. The collective optics of the EUV light is not limited to the EUV collector mirror 16 as shown in FIG. 1, but may be formed by using plural optical components, and it is necessary to form a reflection optics for suppressing absorption of EUV light.

The exposure unit interface 18 has a positioning mechanism relative to the exposure unit for preventing contamination from entering the exposure unit to improve purity of the EUV light. Further, since the EUV light is attenuated in the atmosphere, the plasma 26 is generated within the EUV chamber 10 isolated from the atmosphere. The pressure within the EUV chamber 10 is held at about 0.1 Pa, for example, by an evacuation apparatus.

The target collecting unit 14 is provided in a location facing the target nozzle 13 with the plasma emission point in between. The target collecting unit 14 collects the target material that has been injected from the target nozzle 13 but not turned into plasma without laser beam application and a residue of the target material to which the laser beam has been applied. Thereby, the unwanted target material is prevented from flying and contaminating the EUV collector mirror 16 and so on, and the degree of vacuum within the EUV chamber 10 is prevented from lowering.

The upper electromagnetic coil 30 and the lower electromagnetic coil 32 are provided outside of the EUV chamber 10. The leading end part of the upper magnetic core 34 projects from the end surface of the upper electromagnetic coil 30, and extends into the EUV chamber 10. Further, the leading end part of the lower magnetic core 36 projects from the end surface of the lower electromagnetic coil 32, and extends into the EUV chamber 10. Within the EUV chamber 10, the leading end part of the upper magnetic core 34 and the leading end part of the lower magnetic core 36 are located to face each other with the plasma generation point in between.

The upper magnetic core 34 and the lower magnetic core 36 have hollow structures, and the target supply unit 12 is provided within the upper magnetic core 34 and the target collecting unit 14 is provided within the lower magnetic core 36. The leading end part of the upper magnetic core 34 extends near the leading end of the target supply unit 12, and the leading end part of the lower magnetic core 36 extends near the leading end of the target collecting unit 14. The upper magnetic core 34 and the lower magnetic core 36 are formed of a material having high saturation magnetic flux density such as a ferromagnetic material for downsizing.

Prior to plasma generation, the power supply 33 supplies current to the upper electromagnetic coil 30 and the lower electromagnetic coil 32 to magnetize the upper magnetic core 34 and the lower magnetic core 36, and thereby, a mirror-shaped magnetic field 38 is formed along the trajectory of the target material at least between the trajectory of the target material and the EUV collector mirror. By the upper magnetic core 34 and the lower magnetic core 36 facing each other with the plasma emission point in between, a magnetic field is locally generated only near the plasma with a small gap, and thus, a magnetic field having a strength comparable with that in a conventional technology can be generated around the plasma by smaller electromagnetic coils compared to those of the related technology. Further, by the upper magnetic core 34 and the lower magnetic core 36 extending into the EUV chamber 10, the magnetic field 38 can be generated in a location apart from the upper electromagnetic coil 30 and the lower electromagnetic coil 32, and therefore, the upper electromagnetic coil 30 and the lower electromagnetic coil 32 can be provided outside of the EUV chamber 10.

Fast ions are generated substantially simultaneously with the plasma generation, and the fast ions are caught by the magnetic field around the plasma and ejected in the vertical directions in FIG. 1. Then, the fast ions collide with the upper magnetic core 34 and the lower magnetic core 36 as emission points of the lines of magnetic force, or caught by the target collecting unit 14. Since the upper magnetic core 34 and the lower magnetic core 36 are hit by the ions as described above, the refrigerant paths 40 and 44 for circulating a refrigerant for cooling are formed within the upper magnetic core 34 and the lower magnetic core 36, respectively. The refrigerant paths 40 and 44 are coupled to the refrigerators 42 and 46, respectively, and cool the upper magnetic core 34 and the lower magnetic core 36 because the refrigerators 42 and 46 cool the refrigerant. Further, it is desirable that the surfaces of the upper magnetic core 34 and the lower magnetic core 36 are coated with a material that is hard to be damaged by ion collision.

Materials having high hardness and resistance properties against the sputtering such as TiN, $Si_3N_4$, BN, $Al_2O_3$, $TiO_2$, $MgAl_2O_4$, carbon (C), and titanium (Ti) are suitable for the coating material. Especially, in the case where tin (Sn) is used as the target material, it is preferable that titanium (Ti) having a high wettability for liquid tin and relatively high resistance properties against the sputtering is used as the coating material. Further, in the case where porous titanium is coated on the magnetic cores, even if tin ions reach the magnetic cores and tin adheres to the magnetic cores, tin leaks into pores of the porous titanium, and therefore, it is possible to prevent tin from being sputtered again by fast ions colliding with the magnetic cores.

Embodiment 2

Figure 2A:
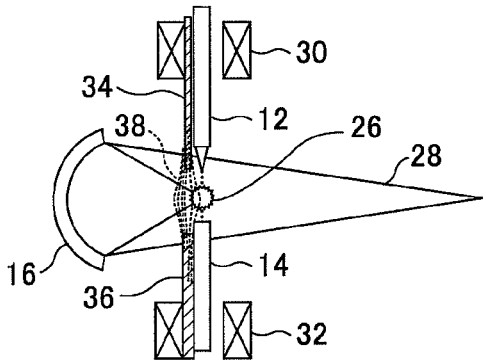
FIGS. 2A and 2B show a partial configuration of an extreme ultraviolet light source apparatus according to the second embodiment of the present invention.
Figure 2B:
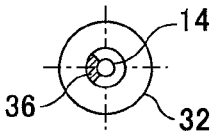

FIGS. 2A and 2B show a partial configuration of an extreme ultraviolet light source apparatus according to the second embodiment of the present invention. FIG. 2A is a side view, and FIG. 2B is a bottom view.

The magnetic field 38 generated for deflecting fast ions may have a distribution in which the magnetic field is stronger between the trajectory of the target material and the EUV collector mirror 16. Accordingly, in the second embodiment, the upper magnetic core 34 and the lower magnetic core 36 are provided only at the EUV collector mirror side of the target supply unit 12 and the target collecting unit 14, and thereby, a strong magnetic field is formed between the trajectory of the target material and the EUV collector mirror 16. The other points are the same as those in the first embodiment.

In the second embodiment, since the strong magnetic field is generated at the EUV collector mirror side of the trajectory of the target material, ions generated from plasma can be prevented from colliding with the EUV collector mirror 16. In addition, the sectional area in which the upper magnetic core 34 and the lower magnetic core 36 block the EUV catching optical path 28 is small, and therefore, there is an advantage that the amount of caught EUV light is larger than that in the first embodiment.

Embodiment 3

Figure 3A:
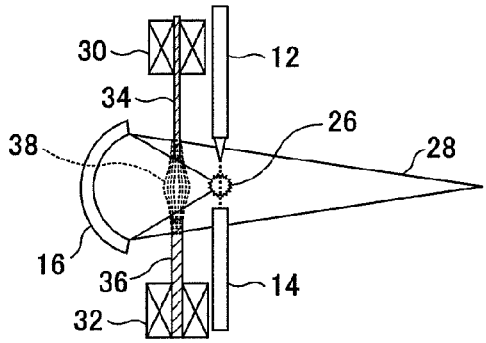
FIGS. 3A-3D show a partial configuration of an extreme ultraviolet light source apparatus according to the third embodiment of the present invention.
Figure 3B:
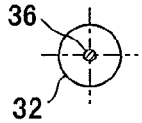
Figure 3C:
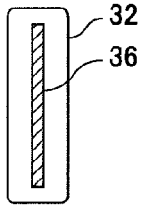
Figure 3D:
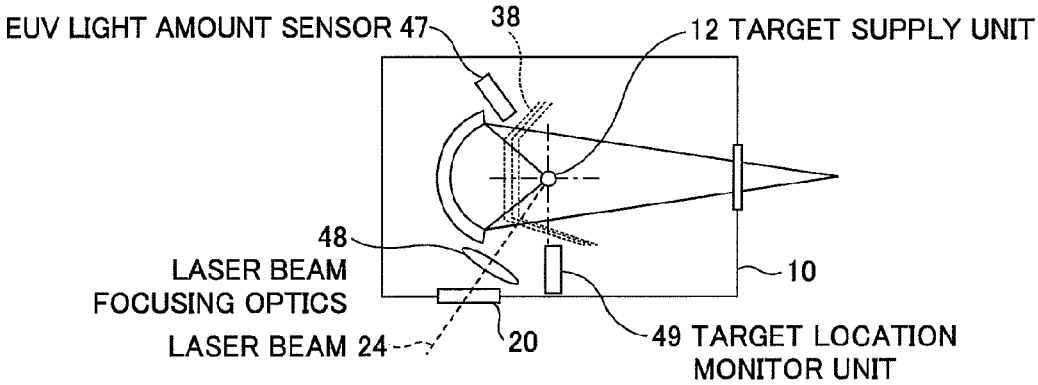

FIGS. 3A-3D show a partial configuration of an extreme ultraviolet light source apparatus according to the third embodiment of the present invention. FIG. 3A is a side view, FIGS. 3B and 3C are bottom views, and FIG. 3D is a plan view.

In the third embodiment, the upper electromagnetic coil 30 and the upper magnetic core 34 are separated from the target supply unit 12, and the lower electromagnetic coil 32 and the lower magnetic core 36 are separated from the target collecting unit 14. The other points are the same as those in the second embodiment.

In the third embodiment, as is in the case of the second embodiment, a strong magnetic field can be formed between the trajectory of the target material and the EUV collector mirror 16. Further, in the third embodiment, the shapes of the magnetic cores can be formed relatively freely. For example, as shown in FIG. 3C, when the upper magnetic core 34 and the lower magnetic core 36 are formed in flat plates, protection against ions can be realized across a wide area.

The shapes of the upper magnetic core 34 and the lower magnetic core 36 are not limited to flat plates, but may be curved to form circular arcs. Since the shapes of the magnetic cores can be formed relatively freely as described above, the magnetic field can be formed according to the size of the EUV collector mirror 16 and the location of the structures within the EUV chamber 10. For example, as shown in FIG. 3D, not only the EUV collector mirror 16 but also optical components such as an EUV light amount sensor 47, a laser beam focusing optics 48, and a target location monitor unit 49 may be targets of protection, and the magnetic field 38 may be formed to shield them from plasma.

Embodiment 4

Figure 4A:
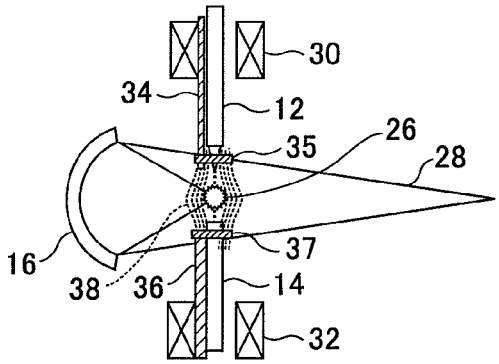
FIGS. 4A and 4B show a partial configuration of an extreme ultraviolet light source apparatus according to the fourth embodiment of the present invention.
Figure 4B:
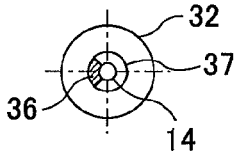

FIGS. 4A and 4B show a partial configuration of an extreme ultraviolet light source apparatus according to the fourth embodiment of the present invention. FIG. 4A is a side view, and FIG. 4B is a bottom view.

In the fourth embodiment, auxiliary rings 35 and 37 are added to the upper magnetic core 34 and the lower magnetic core 36, respectively, and the magnetic field 38 covering the plasma 26 is formed. The auxiliary rings 35 and 37 are formed of a magnetic material. The other points are the same as those in the second embodiment.

In this case, in the same manner as that in the first embodiment, ions generated from the plasma 26 can be caught over substantially all directions and the shadows of the magnetic cores formed in the EUV light path can be minimized.

Since the shapes of the magnetic cores can be formed relatively freely as described above, the magnetic field 38 can be allowed to effectively act according to the location of the structures within the EUV chamber 10. The magnetic field 38 is local and any large electromagnetic coils like those in the conventional case are not necessary. Further, as is in the case of the first embodiment, the upper magnetic core 34 and the lower magnetic core 36 may be cooled or the upper magnetic core 34 and the lower magnetic core 36 may be coated.

Embodiment 5

Figure 5:
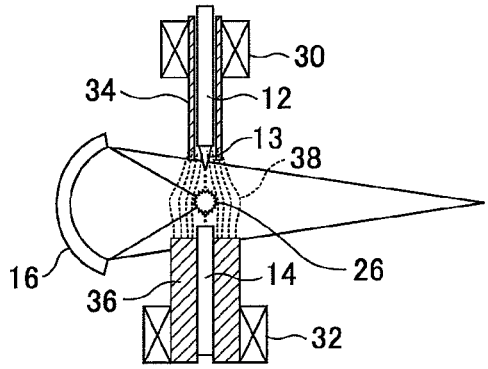
FIG. 5 is a side view showing a partial configuration of an extreme ultraviolet light source apparatus according to the fifth embodiment of the present invention.

FIG. 5 is a side view showing a partial configuration of an extreme ultraviolet light source apparatus according to the fifth embodiment of the present invention. The fifth embodiment is a modification of the first embodiment. In the fifth embodiment, the magnetic field 38 generated for deflecting fast ions has a distribution in which the magnetic field is stronger at the target supply unit side in the trajectory of the target material.

The first to fourth embodiments generate a magnetic field substantially symmetric in the vertical direction. That is, the substantially symmetric magnetic field is generated at the target supply unit side and the target collecting unit side. However, by the magnetic field substantially symmetric in vertical direction, ions captured by the magnetic field are converged homogeneously to the target supply unit side and the target collecting unit side. When a long-period operation is performed under the condition, a problem arises that the target nozzle 13 of the target supply unit 12 deforms due to collision of ions and therefore the trajectory of the target material changes. Durability may be improved by applying an ion-resistant coating or the like on the front surface of the target nozzle 13. However, ions are easily ejected into the space in which lines of magnetic force are sparse, and in the case where the strong magnetic field is formed at the target supply unit side, the amount of ion collision against the target nozzle 13 can be relatively reduced.

Accordingly, in the fifth embodiment, the lower magnetic core 36 at the target collecting unit side is made thicker for reducing magnetic flux density on the end surface of the lower magnetic core 36. Relatively, on the upper magnetic core 34 at the target supply unit side, the magnetic flux density becomes higher and ions hardly reach there.

Embodiment 6

Figure 6:
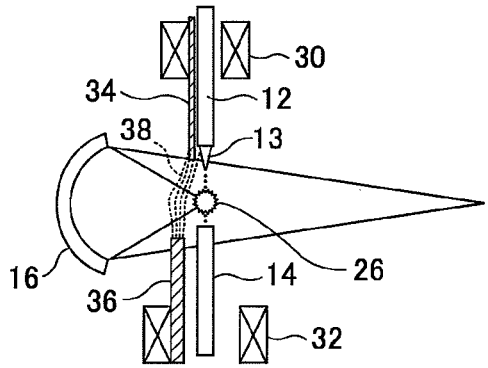
FIG. 6 is a side view showing a partial configuration of an extreme ultraviolet light source apparatus according to the sixth embodiment of the present invention.

FIG. 6 is a side view showing a partial configuration of an extreme ultraviolet light source apparatus according to the sixth embodiment of the present invention. The sixth embodiment is a modified example of the fifth embodiment. In the sixth embodiment, the lower magnetic core 36 at the target collecting unit side is apart from the trajectory of the target material as a center axis of the target supply unit 12 and the target collecting unit 14 so that the magnetic field 38 has a gradient. At the target supply unit side, the magnetic field is close to the target supply unit 12 and ions hardly reach there.

Embodiment 7

Figure 7:
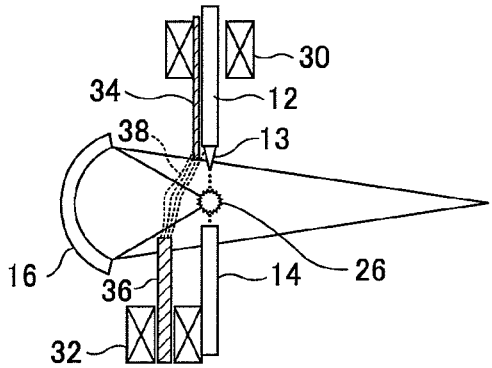
FIG. 7 is a side view showing a partial configuration of an extreme ultraviolet light source apparatus according to the seventh embodiment of the present invention.

FIG. 7 is a side view showing a partial configuration of an extreme ultraviolet light source apparatus according to the seventh embodiment of the present invention. The seventh embodiment is a modified example of the sixth embodiment. In the seventh embodiment, the lower magnetic core 36 at the target collecting unit side is apart from the target collecting unit 14 together with the lower electromagnetic coil 32, and thereby, the magnetic field at the target collecting unit side is made weaker.

Embodiment 8

Figure 8A:
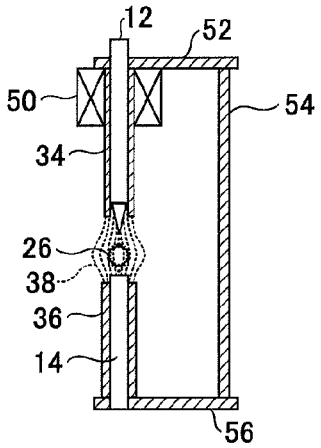
FIGS. 8A and 8B show a partial configuration of an extreme ultraviolet light source apparatus according to the eighth embodiment of the present invention.
Figure 9A:
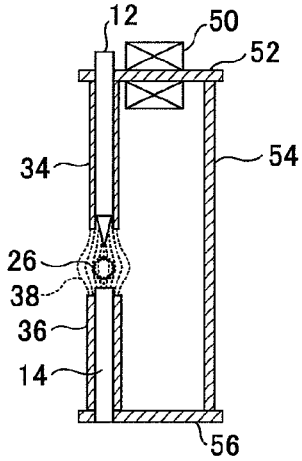
FIGS. 9A and 9B show a partial configuration of an extreme ultraviolet light source apparatus according to a modified example of the eighth embodiment of the present invention.
Figure 8B:
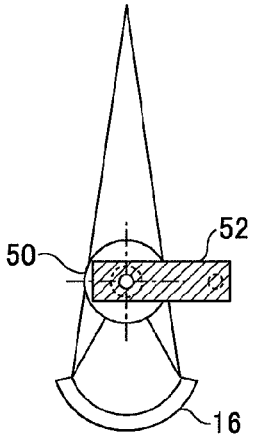
Figure 9B:
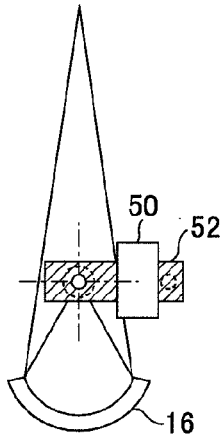

FIGS. 8A and 8B show a partial configuration of an extreme ultraviolet light source apparatus according to the eighth embodiment of the present invention. FIG. 8A is a side view, and FIG. 8B is a plan view. Further, FIGS. 9A and 9B show a partial configuration of an extreme ultraviolet light source apparatus according to a modified example of the eighth embodiment of the present invention. FIG. 9A is a side view, and FIG. 9B is a plan view. In the eighth embodiment and the modified example thereof, the upper and lower magnetic cores are magnetically coupled by using yokes made of a magnetic material.

When the upper magnetic core 34 and the lower magnetic core 36 are coupled by yokes 52, 54, 56, substantially all of the lines of magnetic force pass through magnetic materials except for the gap sandwiching the plasma 26. Thereby, a configuration with little leakage magnetic field to the outside of the magnetic materials can be realized. According to the configuration, it is not necessary to carefully select materials of other structures within the EUV chamber 10, and the magnetic shield is not necessary. Further, in some cases, the number of electromagnetic coils can be reduced. In addition, an electromagnetic coil 50 may be attached to an arbitrary location in the magnetic circuit as shown in FIGS. 8A and 8B or FIGS. 9A and 98, and the degree of freedom of design can be improved.

Further, the surface of at least one of the yokes 52, 54, 56 may be coated with a material that is hard to be damaged by ion collision. Materials having high hardness and resistance properties against the sputtering such as TiN, $Si_3N_4$, BN, $Al_2O_3$, $TiO_2$, $MgAl_2O_4$, carbon (C), and titanium (Ti) are suitable for the coating material. Especially, in the case where tin (Sn) is used as the target material, it is preferable that porous titanium is used as the coating material.

Embodiment 9

Figure 10:
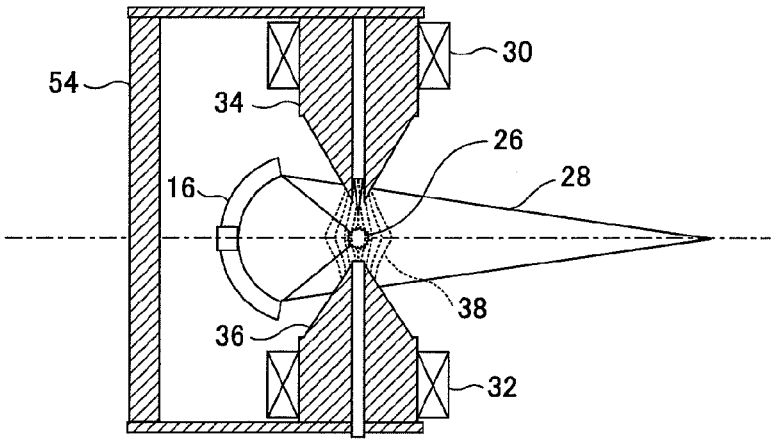
FIG. 10 is a plan view showing a partial configuration of an extreme ultraviolet light source apparatus according to the ninth embodiment of the present invention.

FIG. 10 is a plan view showing a partial configuration of an extreme ultraviolet light source apparatus according to the ninth embodiment of the present invention. In the ninth embodiment, the leading end parts of the upper magnetic core 34 and the lower magnetic core 36 are formed in conical shapes and shadows of the upper magnetic core 34 and the lower magnetic core 36 formed in the EUV catching optical path 28 are made smaller.

The part blocking the EUV catching optical path 28 is only the periphery of the leading end of the target nozzle 13 and the leading end of the target collecting unit 14, and therefore, the acquisition efficiency of the EUV light can be improved. Further, in FIG. 10, the target supply unit 12 and the target collecting unit 14 are horizontally provided and the target material is horizontally outputted, and thereby, the trajectory of the target material is set in the horizontal direction. In this way, even when the direction of the trajectory of the target material changes, the target motion and the ion removal function are not so different as long as the target injection capability can be ensured.

Embodiment 10

Figure 11:
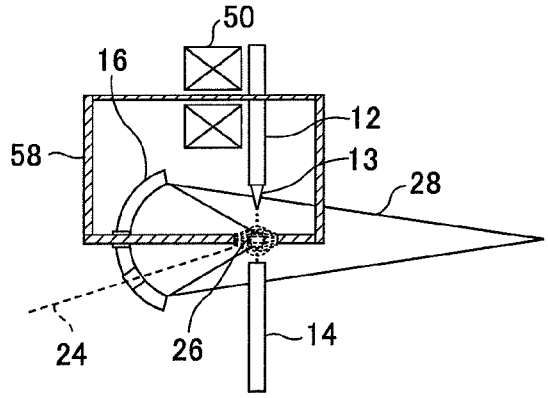
FIGS. 11-13 are side views showing a partial configuration of an extreme ultraviolet light source apparatus according to the tenth embodiment of the present invention.
Figure 12:
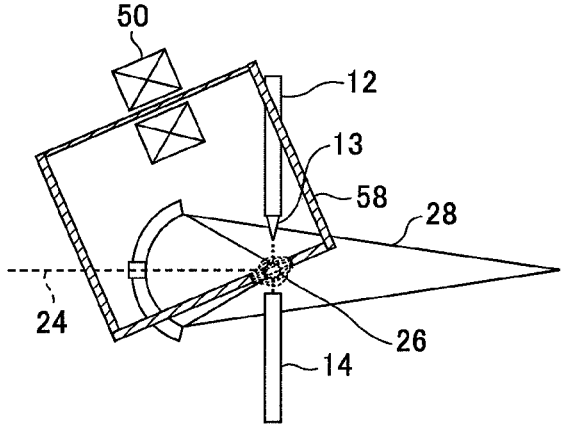
Figure 13:
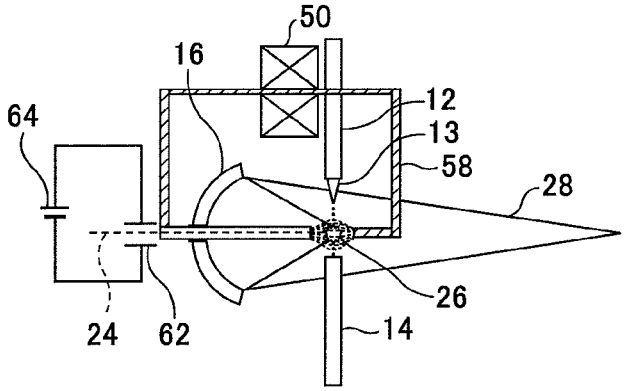

FIGS. 11-13 are side vies showing a partial configuration of an extreme ultraviolet light source apparatus according to the tenth embodiment of the present invention. In the tenth embodiment, the magnetic circuit is configured by a magnetic core 58 passing through the axis part of the electromagnetic coil 50 and formed with a gap in the plasma emission point. The magnetic core 58 may penetrate the EUV collector mirror 16.

When the magnetic core 58 formed with a gap in the plasma emission point is used, ions radiated from the plasma 26 are caught and collide with the magnetic core 58, and thus, the target nozzle 13 is protected. In addition, since the magnetic field is formed to surround the plasma 26, ions moving toward the EUV collector mirror 16 are reduced and the EUV collector mirror 16 is also protected. Further, most of the lines of magnetic force pass through the magnetic core 58, and the leakage magnetic field to the outside is very scarce.

FIGS. 11 and 12 show variations of the positional relationship between the incident direction of the laser beam 24 and the magnetic core 58. As shown in FIG. 11, the magnetic core 58 may be allowed to penetrate the center axis of the EUV collector mirror 16 so that the shadow of the magnetic core 58 in the EUV catching optical path 28 is minimized. Alternatively, as shown in FIG. 12, with the emphasis on the ease of alignment, the laser beam 24 may be allowed to enter the center axis of the EUV collector mirror 16, and the magnetic core 58 may be provided to avoid the center axis of the EUV collector mirror 16.

Further, as shown in FIG. 13, a cavity may be formed in a part of the magnetic core 58 sandwiching the plasma emission point, and the cavity may be used as an incident path of the laser beam 24. According to the arrangement as shown in FIG. 13, the shadow of the magnetic core 58 formed in the EUV catching optical path 28 can be minimized and alignment of the laser incident axis is easy. However, ions are ejected to the laser incident axis, and therefore, the ions may collide with the laser beam focusing optics and damage it. In order to avoid this, it is desirable to provide a bias electrode 62 for catching ions, a direct-current power supply 64 for supplying a direct-current voltage to the bias electrode 62, or the like.

Embodiment 11

Figure 14:
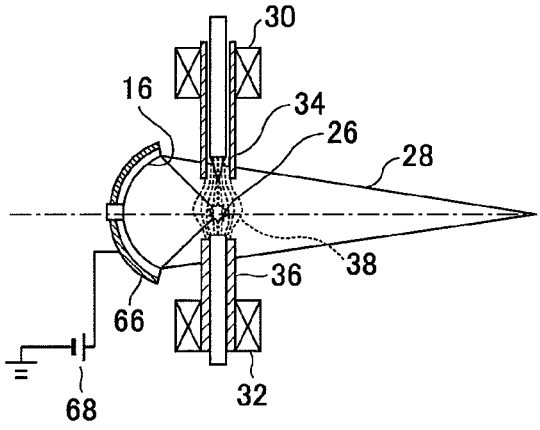
FIGS. 14-16 are side views showing a partial configuration of an extreme ultraviolet light source apparatus according to the eleventh embodiment of the present invention.
Figure 15:
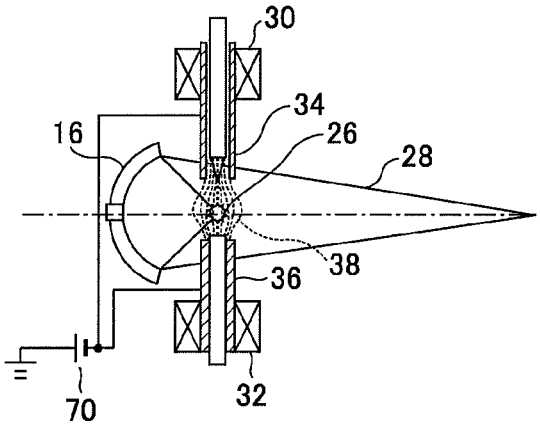
Figure 16:
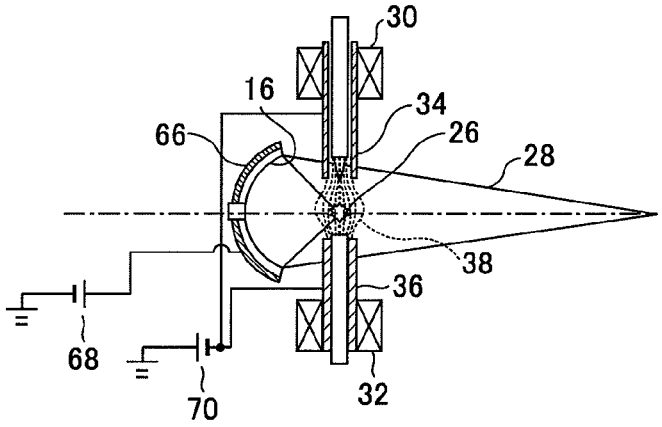

FIGS. 14-16 are side views showing a partial configuration of an extreme ultraviolet light source apparatus according to the eleventh embodiment of the present invention. Since ions are affected not only by a magnetic field but also by an electric field, the electric field may be also used by utilizing the influence. In the eleventh embodiment, the action of the electric field is also used and the ion protection effect of the EUV collector mirror can be increased. The other points are the same as those in the first embodiment.

FIG. 14 shows a partial configuration of an EUV light source apparatus with further improved ion protection effect by forming an electrode 66, which repulses the ions, on the rear surface of the EUV collector mirror 16. The electrode 66 is provided on the rear surface of the EUV collector mirror 16, and a direct-current power supply 68 supplies a voltage having the same polarity as that of the ions to the electrode 66. Thereby, the electric field that repulsively acts on the ions is formed on the front surface of the EUV collector mirror 16, and therefore, the ions with high energy passing through the magnetic field 38 can be prevented to reach the EUV collector mirror 16.

FIG. 15 shows a partial configuration of an EUV light source apparatus using the upper magnetic core 34 and the lower magnetic core 36 as electrodes. A direct-current power supply 70 supplies a voltage having a different polarity from that of ions to the upper magnetic core 34 and the lower magnetic core 36. Thereby, the EUV collector mirror 16 can be protected by allowing the ions to aggressively collide with the upper magnetic core 34 and the lower magnetic core 36, but not to collide with the EUV collector mirror 16. In this case, it is desirable to take measures for ion protection of coating or the like on the upper magnetic core 34 and the lower magnetic core 36.

FIG. 16 shows a partial configuration of an EUV light source apparatus using both the configuration as shown in FIG. 14 and the configuration as shown in FIG. 15. The direct-current power supply 68 supplies a voltage having the same polarity as that of ions to the electrode 66 formed on the rear surface of the EUV collector mirror 16 to repulse the ions, and the direct-current power supply 70 applies a voltage having a different polarity from that of ions to the upper magnetic core 34 and the lower magnetic core 36 to absorb the ions. Therefore, according to the configuration as shown in FIG. 16, the probability that the ions collide with the EUV collector mirror 16 becomes lower.

Embodiment 12

Figure 17:
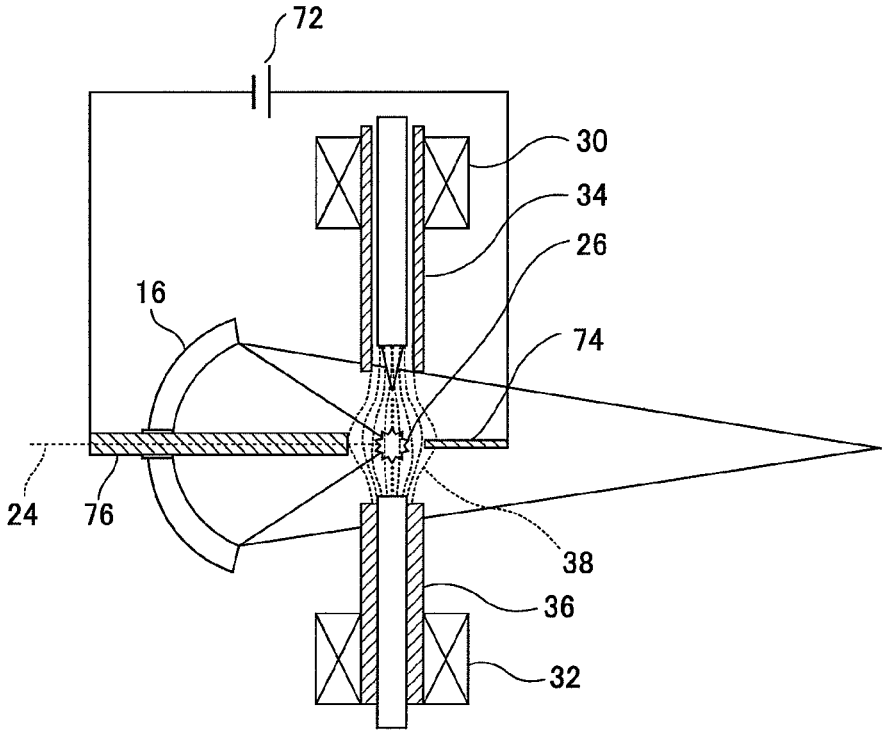
FIG. 17 is a side view showing a partial configuration of an extreme ultraviolet light source apparatus according to the twelfth embodiment of the present invention.

FIG. 17 is a side view showing a partial configuration of an extreme ultraviolet light source apparatus according to the twelfth embodiment of the present invention. In the twelfth embodiment, the ion protection effect of the EUV collector mirror is increased also by using the action of the electric field.

The EUV light source apparatus has a function of forming the mirror magnetic field 38 around the plasma emission point to prevent sputtering of the EUV collector mirror 16 due to ions radiated from the plasma 26, and a function of forming an electric field in the plasma emission point to prevent the ions from moving to the EUV collector mirror 16. The other points are the same as those in the first embodiment.

As shown in FIG. 17, an electrode rod 76 having a hollow structure is provided in the optical path of the laser beam 24 and an opposite electrode rod 74 is provided with the plasma emission point in between, and a direct-current power supply 72 supplies a direct-current voltage between the electrode rod 76 and the electrode rod 74. Thereby, the ions not caught by the magnetic field 38 but emitted to the EUV collector mirror side are caught by the electrode rod 76 having a potential with opposite polarity to that of ions. In this case, the inner surface of the tubular electrode rod 76 is also the ion collision surface, and therefore, the amount of ion collision per unit area decreases, and the damage on the upper magnetic core 34 and the lower magnetic core 36 can be reduced. The amount of ions passing through the hole of the electrode rod 76 is extremely small, and the possibility that the laser beam focusing optics is subjected to ion collision is low.

In the embodiment, the potential of the electrode rod 76 also serving as the laser optical path has opposite polarity to that of ions. Alternatively, the potential of the electrode rod 76 may have the same polarity as that of ions and the potential of the opposed electrode rod 74 may have opposite polarity to that of ions, so that the ions are allowed to collide with the opposed electrode rod 74.

Embodiment 13

Figure 18:
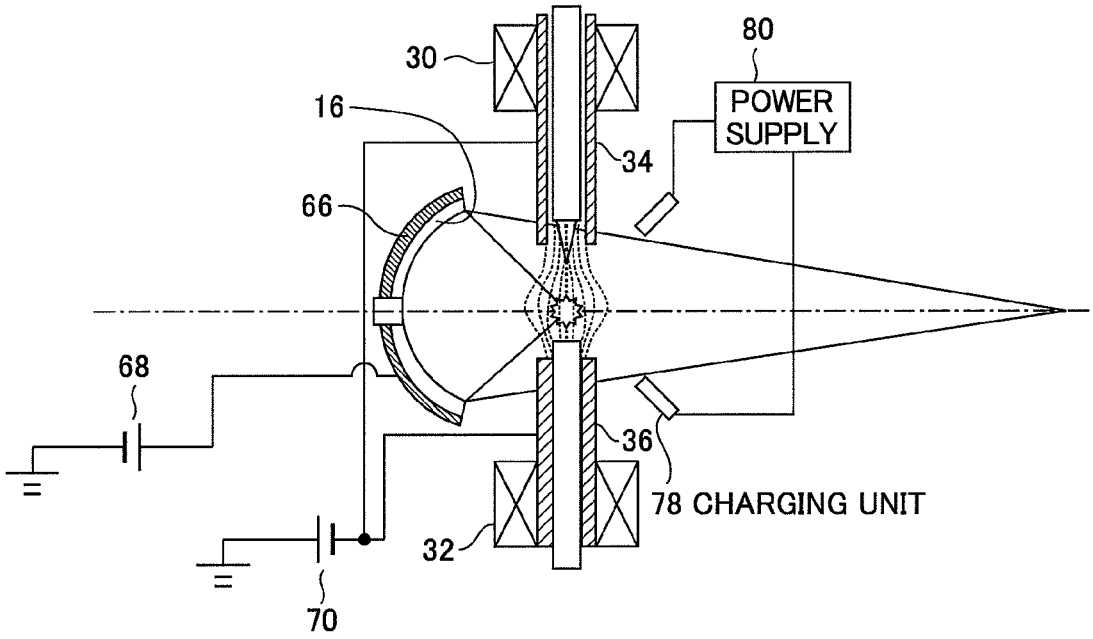
FIG. 18 is a side view showing a partial configuration of an extreme ultraviolet light source apparatus according to the thirteenth embodiment of the present invention.

FIG. 18 is a side view showing a partial configuration of an extreme ultraviolet light source apparatus according to the thirteenth embodiment of the present invention. In the thirteenth embodiment, particles radiated from plasma are aggressively charged and removed by using the action of the magnetic field and/or electric field, and thereby, the ion protection effect of the EUV collector mirror is increased. The other points are the same as those in the first embodiment.

The EUV light source apparatus includes the direct-current power supply 68 for supplying a direct-current voltage to the electrode 66 formed on the rear surface of the EUV collector mirror 16, a direct-current power supply 70 for supplying a direct-current voltage to the upper magnetic core 34 and the lower magnetic core 36, a charging unit 78 such as an electron gun or a microwave source for charging particles radiated from the plasma, and a power supply 80 for supplying a voltage to the charging unit 78.

Depending on conditions of the target material, laser beam, and so on, there is a case where the ionization rate of the particles radiated from the plasma is low. In such a case, the charging unit 78 aggressively charges the particles radiated from the plasma. If the particles can be charged, the charged particles can be caught by utilizing the action of the mirror magnetic field generated by the upper electromagnetic coil 30 and the lower electromagnetic coil 32 and/or the electric field generated by the electrode 66, the upper magnetic core 34 and the lower magnetic core 36. Therefore, even when the ionization rate is low, the particles radiated from the plasma can be effectively caught and the EUV collector mirror 16 can be protected.

Embodiment 14

Figure 19A:
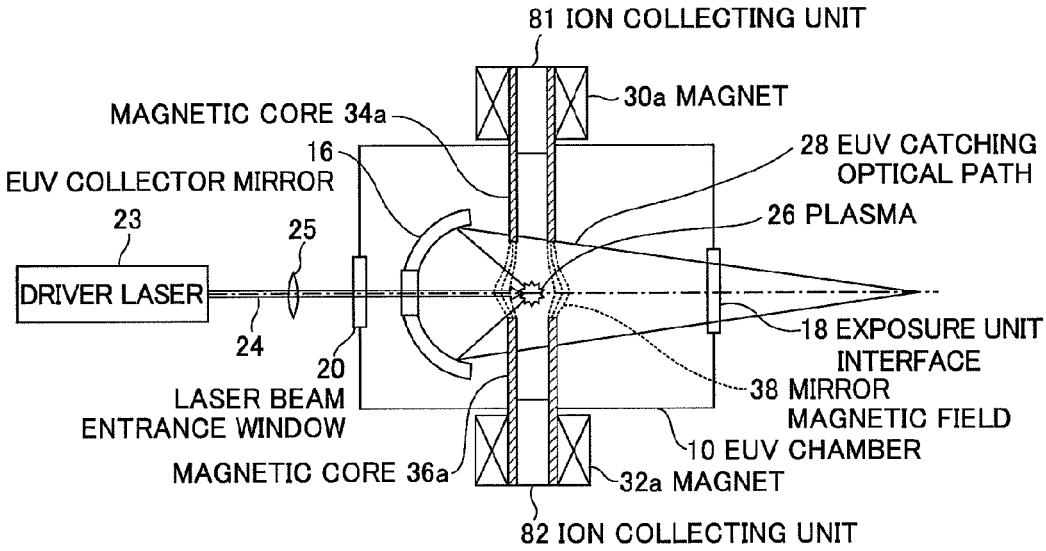
FIGS. 19A and 19B show a partial configuration of an extreme ultraviolet light source apparatus according to the fourteenth embodiment of the present invention.
Figure 19B:
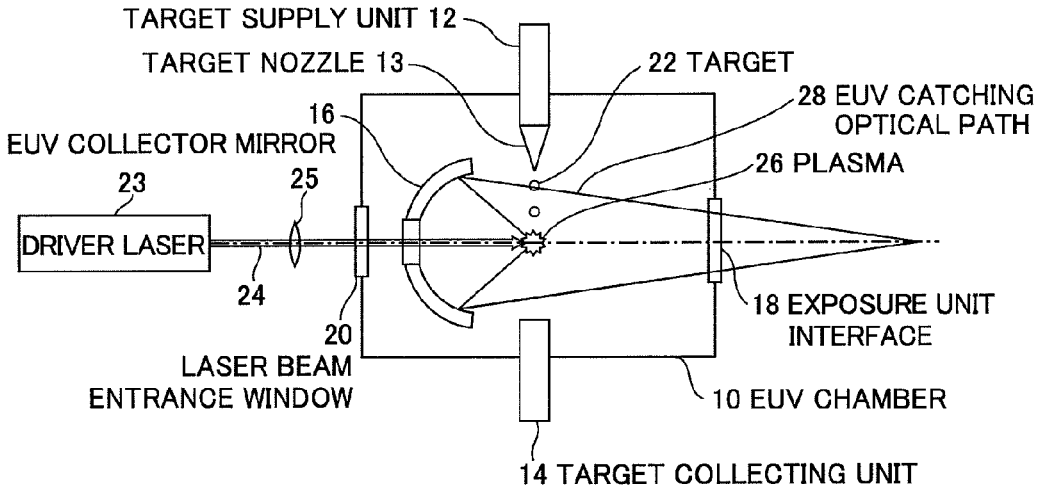

FIGS. 19A and 19B show a partial configuration of an extreme ultraviolet light source apparatus according to the fourteenth embodiment of the present invention. FIG. 19A is a plan view seen from the above, and FIG. 19B is a side view. In the fourteenth embodiment, each component is arranged such that a trajectory of the target material and a direction of the magnetic field are substantially orthogonal to each other. Further, as the magnetic sources, magnets are employed in place of the electromagnetic coils. The other points are the same as those in the first embodiment.

As shown in FIG. 19A, the EUV light source apparatus includes a magnet 30*a*, a magnet 32*a*, a magnetic core (magnetic material) 34*a* to be magnetized by the magnet 30*a*, and a magnetic core (magnetic material) 36*a* to be magnetized by the magnet 32*a*. The magnetic core 34*a* forming a cylinder is provided along the inner wall of the magnet 30*a*, and the magnetic core 36*a* forming a cylinder is provided along the inner wall of the magnet 32*a*. An ion collecting unit 81 is provided inside of the cylinder formed of the magnetic core 34*a*, and an ion collecting unit 82 is provided inside of the cylinder formed of the magnetic core 36*a*. The ion collecting units 81 and 82 collects the ions that are captured by the magnetic field and ejected in the horizontal directions.

As shown in FIG. 19B, in the EUV light source apparatus, a target 22 is injected from the target nozzle 13 of the target supply unit 12. The target nozzle 13 injects a target material supplied from the target supply unit 12 to supply the droplet target 22 to a predetermined position (plasma emission point) within the EUV chamber 10.

The driver laser 23 outputs the laser beam 24 to be applied to the target 22 to turn the target 22 into plasma. Further, the focusing lens 25 focuses the laser beam 24 outputted from the driver laser 23 and applies it to the plasma emission point. The laser beam 24 is applied from the driver laser 23 through the focusing lens 25 and the laser beam entrance window 20 to the target 22. Thereby, the target 22 is excited and plasma 26 is generated, and various lights including EUV light having a wavelength of 13.5 nm are radiated from the plasma 26.

The EUV collector mirror 16 collects a predetermined wavelength component (e.g., EUV light near 13.5 nm) from the various wavelength components radiated from the plasma 26. By the EUV collector mirror 16, the EUV light is reflected and collected in a predetermined direction along the EUV catching optical path 28 and outputted through the exposure unit interface 18 to the exposure unit.

The target collecting unit 14 is provided in a location facing the target nozzle 13 with the plasma emission point in between. The target collecting unit 14 collects the target material that has been injected from the target nozzle 13 but not turned into plasma without laser beam application and a residue of the target material to which the laser beam has been applied.

Referring to FIG. 19A again, the magnets 30*a* and 32*a* are provided outside of the EUV chamber 10. The leading end part of the magnetic core 34*a* projects from the end surface of the magnet 30*a*, and extends into the EUV chamber 10. Further, the leading end part of the magnetic core 36*a* projects from the end surface of the magnet 32*a*, and extends into the EUV chamber 10. Within the EUV chamber 10, the leading end part of the magnetic core 34*a* and the leading end part of the magnetic core 36*a* are located to face each other with the plasma generation point in between.

The magnetic cores 34*a* and 36*a* are respectively magnetized by magnets 30*a* and 32*a*, and thereby, a mirror-shaped magnetic field 38 is formed along the trajectory of the target material at least between the trajectory of the target material and the EUV collector mirror. By the magnetic cores 34*a* and 36*a* facing each other with the plasma emission point in between, a magnetic field is locally generated only near the plasma with a small gap, and thus, a magnetic field having a certain strength can be generated around the plasma by smaller magnets. Further, by the magnetic cores 34*a* and 36*a* extending into the EUV chamber 10, the magnetic field 38 can be generated in a location apart from the magnets 30*a* and 32*a*, and therefore, the magnets 30*a* and 32*a* can be provided outside of the EUV chamber 10.

Fast ions are generated substantially simultaneously with the plasma generation, and the fast ions are caught by the magnetic field around the plasma and ejected in the horizontal directions. Then, the fast ions collide with the magnetic cores 34*a* and 36*a* as emission points of the lines of magnetic force, or caught by the ion collecting units 81 and 82.

According to the fourteenth embodiment, since ions are apt to not collide with the target nozzle 13, the target nozzle 13 is not sputtered and it is possible to supply the target 22 stably. Further, the lifetime of the target nozzle 13 can be improved. Since the target material that has not been applied with the laser beam is also collected in the target collecting unit 14, a large amount of the target material is accumulated. When the fast ions are incident upon the target material accumulated in the target collecting unit 14, the target material is sputtered to spout. The EUV light source apparatus according to the fourteenth embodiment can prevent this phenomenon.

Although the magnets are arranged outside of the EUV chamber 10 in the fourteenth embodiment, the present invention is not limited to the embodiment, but the magnets 30*a* and 32*a* or the ion collecting units 81 and 82 may be arranged inside of the EUV chamber 10.

Embodiment 15

Figure 20:
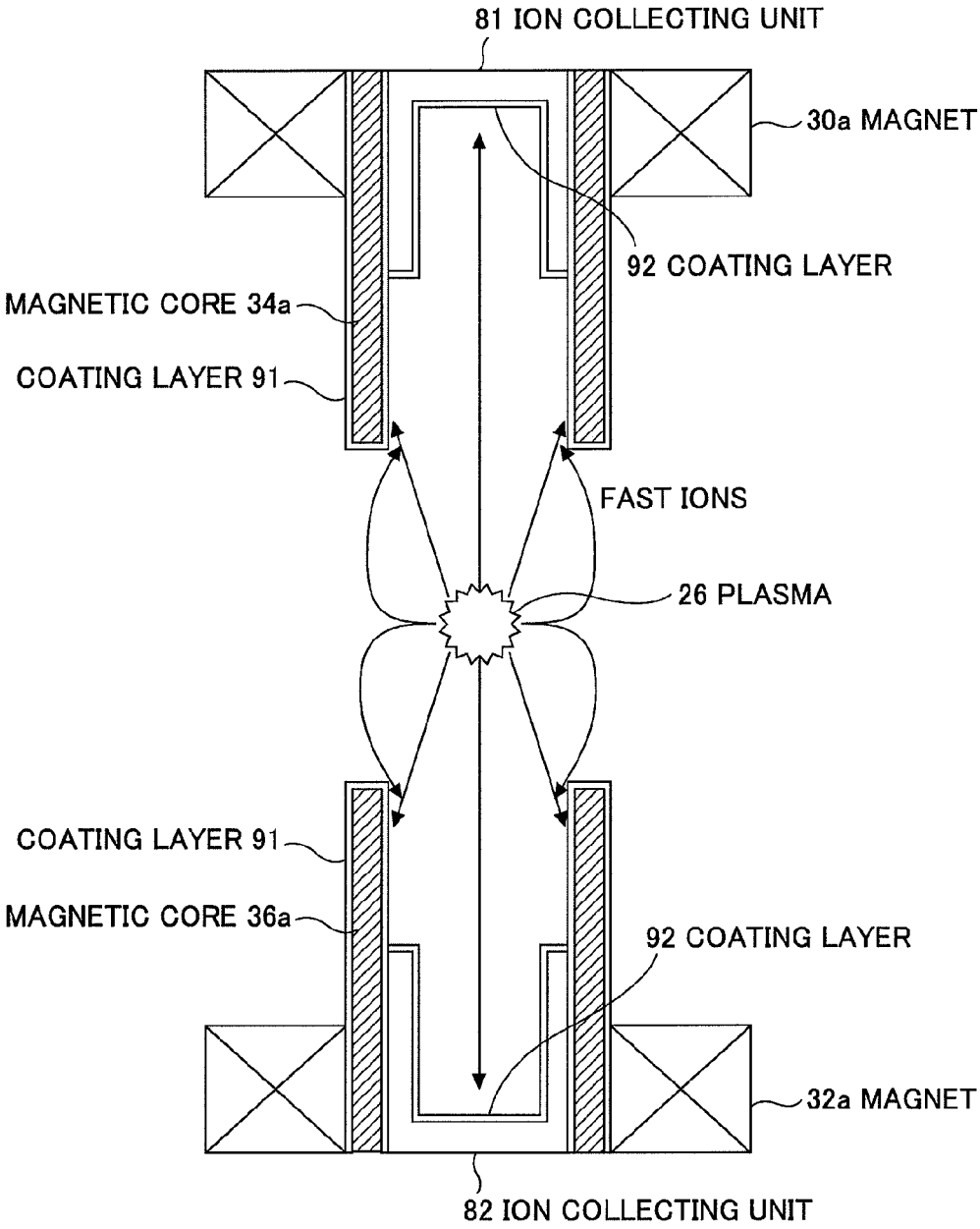
FIG. 20 is a plan view showing a partial configuration of an extreme ultraviolet light source apparatus according to the fifteenth embodiment of the present invention.
Figure 21:
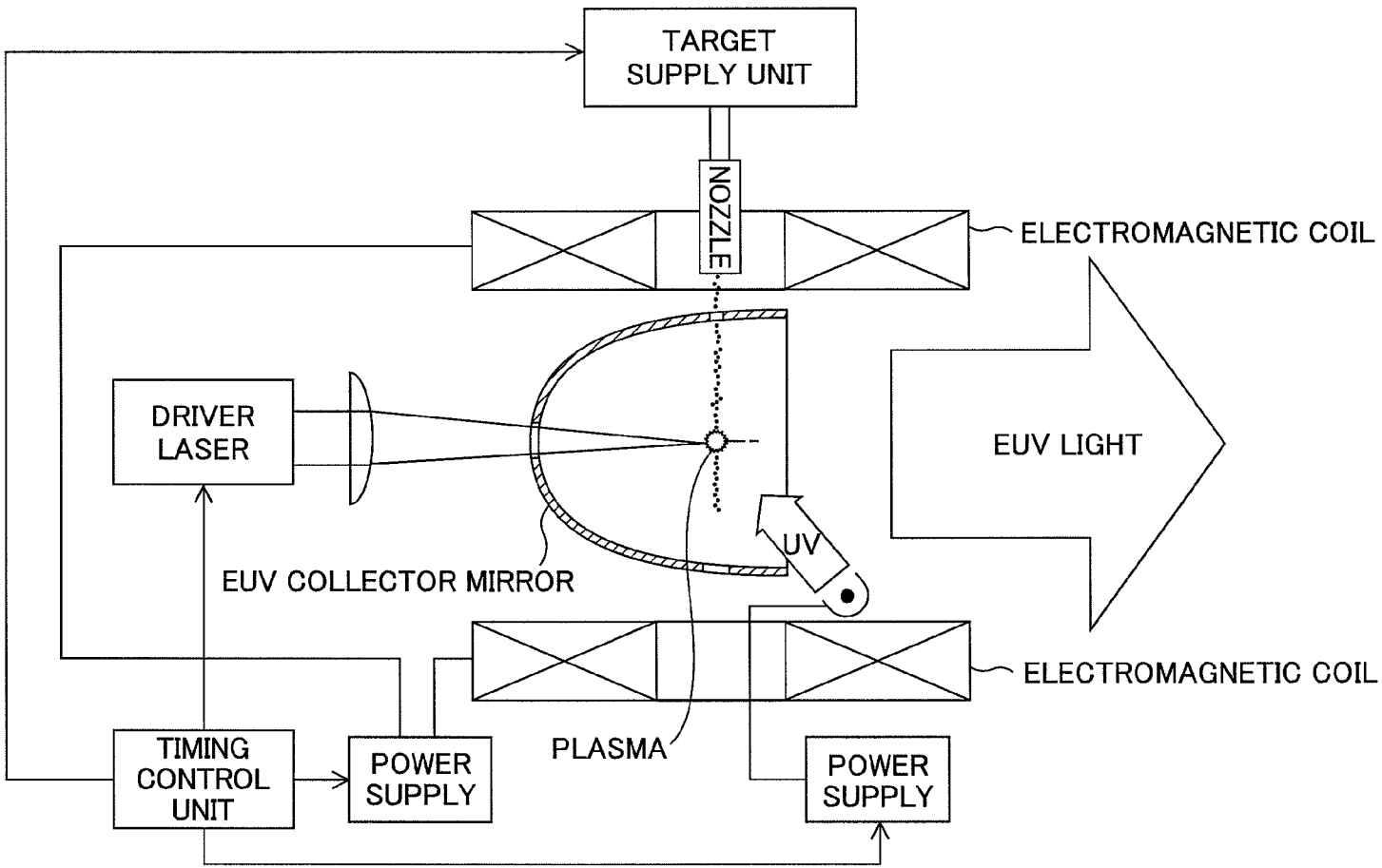
FIG.21 PRIOR ART
FIG. 21 shows a configuration of an extreme ultraviolet light source apparatus according to a conventional technology.
Figure 22:
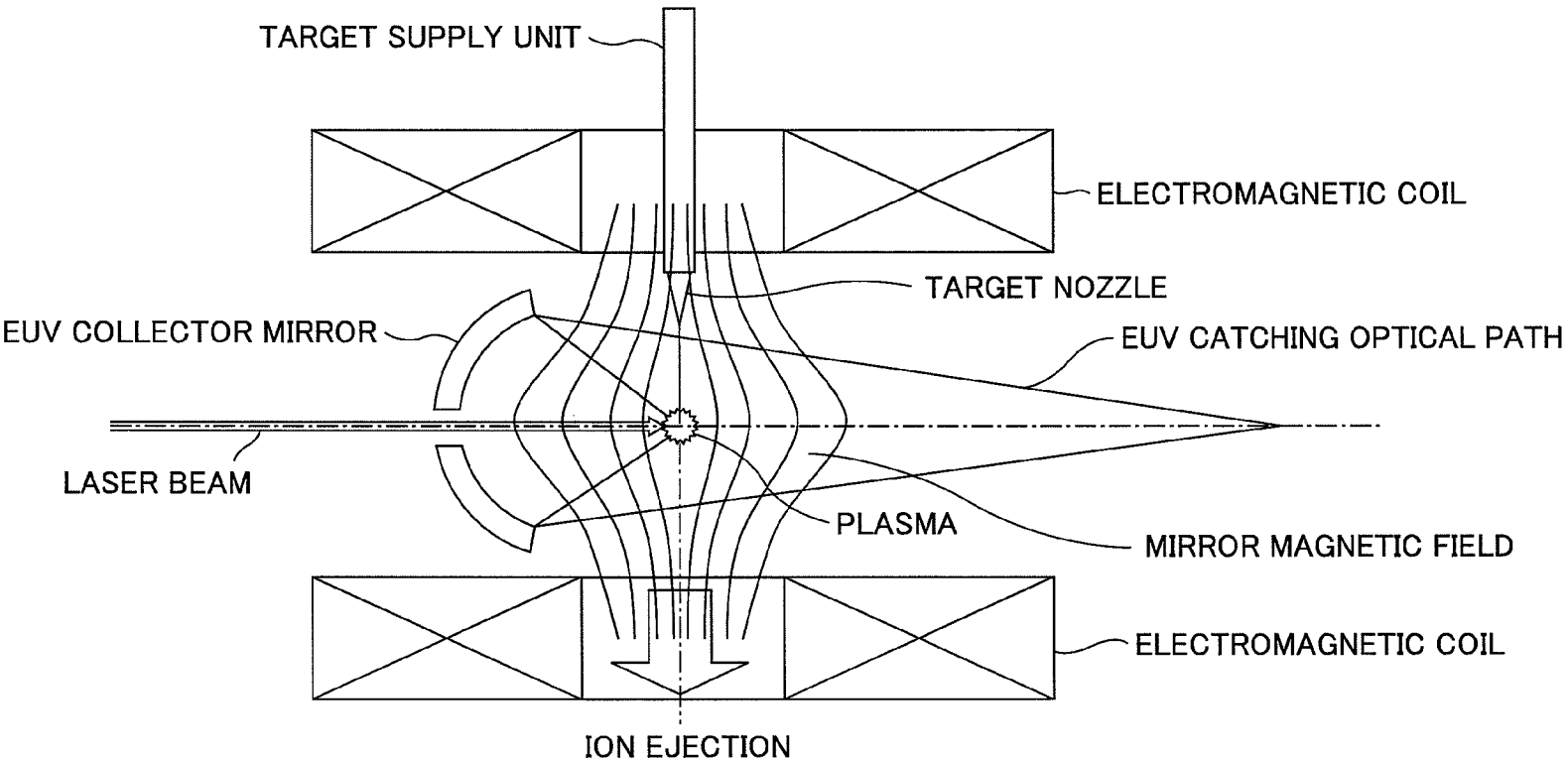
FIG.22 PRIOR ART
FIG. 22 is a diagram for explanation of an ion protection method using a magnetic field according to a conventional technology.

FIG. 20 is a plan view showing a partial configuration of an extreme ultraviolet light source apparatus according to the fifteenth embodiment of the present invention. The fifteenth embodiment is a modification of the fourteenth embodiment. In the fifteenth embodiment, the surfaces of the magnetic cores and/or the ion collecting units are coated with a material for preventing the sputtering.

In order to increase the strength of the magnetic field around the plasma 26, it is necessary that the magnetic cores 34*a* and 36*a* extend to as near positions as possible to the plasma 26. However, the fast ions radiated from the plasma 26 collide with the magnetic cores 34*a* and 36*a* to sputter the material of the magnetic cores. The sputtered material of the magnetic cores adheres to optical elements (for example, the laser beam entrance window 20 and the EUV collector mirror 16), and reduces the collecting efficiency of the laser beam and the collecting efficiency of the EUV light, respectively.

Accordingly, in order to prevent the sputtering, it is desirable that the surfaces of the magnetic cores 34*a* and 36*a* are coated with a material that is hard to be damaged by ion collision so as to form a coating layer 91. Materials having high hardness and resistance properties against the sputtering such as TiN, $Si_3N_4$, BN, $Al_2O_3$, $TiO_2$, $MgAl_2O_4$, carbon (C), and titanium (Ti) are suitable for the coating material. Especially, in the case where tin (Sn) is used as the target material, it is preferable that titanium (Ti) having a high wettability for liquid tin and relatively high resistance properties against the sputtering is used as the coating material. Further, in the case where porous titanium is coated on the magnetic cores, even if tin ions reach the magnetic cores and tin adheres to the magnetic cores, tin leaks into pores of the porous titanium, and therefore, it is possible to prevent tin from being sputtered again by fast ions colliding with the magnetic cores.

Further, the surfaces of the ion collecting units 81 and 82 may be coated with the coating material as mentioned above so as to form a coating layer 92. Thereby, even if the fast ions radiated from the plasma 26 collide with the surfaces of the ion collecting units 81 and 82, the surfaces of the ion collecting units 81 and 82 become hardly sputtered.

Furthermore, in the case where the magnets 30*a* and 32*a* are arranged inside of the EUV chamber 10, the surfaces of the magnets 30*a* and 32*a* may be coated with the coating material as mentioned above.

In the first to thirteenth embodiments as described above, as the magnetic sources, magnets may be employed in place of the electromagnetic coils. Further, in the fourteenth to fifteenth embodiments, as the magnetic sources, electromagnetic coils may be employed in place of the magnets.

The invention claimed is:

1. An extreme ultraviolet light source apparatus for generating extreme ultraviolet light by introducing a laser beam and irradiating a target material with the laser beam to turn the target material into plasma, said apparatus comprising: a chamber in which the extreme ultraviolet light is generated;

a target supply unit configured to supply the target material toward a plasma emission point within said chamber;

a collector mirror configured to collect the extreme ultraviolet light radiated from the plasma;

a first magnetic source;

a first magnetic material to be magnetized by said first magnetic source, said first magnetic material having a leading end portion projecting from an inner wall of said first magnetic source toward the plasma emission point;

a second magnetic source, and a second magnetic material to be magnetized by said second magnetic source, said second magnetic material having a leading end portion projecting from an inner wall of said second magnetic source toward the plasma emission point, wherein the leading end portion of said first magnetic material and the leading end portion of said second magnetic material face each other with the plasma emission point in between.

2. The extreme ultraviolet light source apparatus according to claim 1, further comprising a yoke passing through an opening formed in the first magnetic source, wherein the first magnetic material has one leading end portion connected to a leading end portion of the yoke, and another leading end portion located to face the plasma.

3. The extreme ultraviolet light source apparatus according to claim 1, wherein the first and second magnetic materials are located between a trajectory of the target material and said collector mirror.

4. The extreme ultraviolet light source apparatus according to claim 1, further comprising a target collecting tube configured to collect the target material, wherein:

the first magnetic material has a cylinder shape surrounding said target supply unit, and the second magnetic material has a cylinder shape surrounding said target collecting tube.

5. The extreme ultraviolet light source apparatus according to claim 4, wherein a volume of said first magnetic material is smaller than a volume of said second magnetic material.

6. The extreme ultraviolet light source apparatus according to claim 1, wherein a path configured to circulate a refrigerant is formed within the first magnetic material.

7. The extreme ultraviolet light source apparatus according to claim 1, wherein one of said first and second magnetic materials has a through hole through which the laser beam passes.

8. The extreme ultraviolet light source apparatus according to claim 1, wherein:

said first and second magnetic sources are provided outside of said chamber, and each of said first and second magnetic materials have one leading end portion connected to a respective one of the first and second magnetic sources outside of said chamber, and another leading end portion extending into said chamber.

9. The extreme ultraviolet light source apparatus according to claim 1, further comprising within said chamber:

an extreme ultraviolet (EUV) light amount sensor;

laser beam focusing optics; and a target location monitor unit, wherein the first magnetic material is located to form a magnetic field between the plasma and at least one of said EUV light amount sensor, said laser beam focusing optics, and said target location monitor unit.

10. The extreme ultraviolet light source apparatus according to claim 1, further comprising:

an electrode formed on a rear surface of said collector mirror; and a power supply configured to apply a voltage to said electrode.

11. The extreme ultraviolet light source apparatus according to claim 10, further comprising:

a charging unit configured to charge particles radiated from the plasma.

12. The extreme ultraviolet light source apparatus according to claim 1, further comprising:

a power supply configured to apply a voltage to the first magnetic material.

13. The extreme ultraviolet light source apparatus according to claim 12, further comprising:

a charging unit configured to charge particles radiated from the plasma.

14. The extreme ultraviolet light source apparatus according to claim 1, further comprising:

two electrodes facing each other with the plasma in between; and a power supply configured to apply a voltage between said two electrodes.

15. The extreme ultraviolet light source apparatus according to claim 14, wherein one of the two electrodes has a through hole through which the laser beam passes.

16. The extreme ultraviolet light source apparatus according to claim 15, further comprising:

a charging unit configured to charge particles radiated from the plasma.

17. The extreme ultraviolet light source apparatus according to claim 14, further comprising:

a charging unit configured to charge particles radiated from the plasma.

18. The extreme ultraviolet light source apparatus according to claim 1, wherein the surface of the first magnetic material is coated with a material including one of TiN, $Si_3N_4$, BN, $Al_2O_3$, $TiO_2$, $MgAl_2O_4$, carbon (C), titanium (Ti), and porous titanium.

19. An extreme ultraviolet light source apparatus for generating extreme ultraviolet light by introducing a laser beam and irradiating a target material with the laser beam to turn the target material into plasma, the apparatus comprising:

a chamber in which the extreme ultraviolet light is generated;

a target supply unit configured to supply the target material toward a plasma emission point within the chamber;

a collector mirror configured to collect the extreme ultraviolet light radiated from the plasma;

a plurality of electromagnetic coils disposed outside of the chamber;

a plurality of magnetic cores which respectively project from an inner wall of said plurality of electromagnetic coils toward the plasma emission point to face each other with the plasma emission point in between; and a yoke configured to connect said plurality of magnetic cores to each other.

* * * * *